US007090569B1

(12) United States Patent
Chang

(10) Patent No.: US 7,090,569 B1
(45) Date of Patent: Aug. 15, 2006

(54) MANUAL CLUTCH DEVICE FOR A ROLLER SANDER FOR CONTROLLING RECIPROCATING MOVEMENT OF A ROLLER

(75) Inventor: Richard Chang, Fang Yuan (TW)

(73) Assignee: Kingsand Machinery Ltd., Taichung Hsien (TW)

( * ) Notice: Subject to any disclaimer, the term of this patent is extended or adjusted under 35 U.S.C. 154(b) by 0 days.

(21) Appl. No.: 11/269,756

(22) Filed: Nov. 9, 2005

(51) Int. Cl.
*B24B 7/00* (2006.01)

(52) U.S. Cl. ..... 451/120; 451/124; 451/150; 451/164; 451/167

(58) Field of Classification Search ..... 451/11, 451/120, 124, 130, 150, 164, 167, 184
See application file for complete search history.

(56) References Cited

U.S. PATENT DOCUMENTS 3,849,940 A * 11/1974 Yoshino et al. ..... 451/27
4,094,104 A * 6/1978 Zerfahs et al. ..... 451/184
4,267,671 A * 5/1981 Rettew ..... 451/297
4,635,402 A * 1/1987 Sakabe et al. ..... 451/193
4,730,419 A * 3/1988 Nagata et al. ..... 451/5
2004/0142645 A1* 7/2004 Maus, Jr. ..... 451/124

* cited by examiner

*Primary Examiner*—Eileen P. Morgan
(74) *Attorney, Agent, or Firm*—Troxell Law Office, PLLC

(57) ABSTRACT

A clutch device for a roller sand for controlling reciprocating movement of a roller includes a belt wheel, a connecting shaft and a adjusting button. The roller sander consists of a base, a motor set, a roller set and a linking device. The belt wheel is pivotally connected with the connecting shaft, mounted around by a belt that is also mounted around a belt wheel of a shaft of the motor set. In addition, the belt wheel of the clutch device is provided with plural fixing grooves at its front end. The adjusting button is connected with the connecting shaft, provided with a fixing bar fitting in a slot in an annular outer surface of said connecting shaft. Then the adjusting button is pushed in or pulled out to let the roller reciprocate or not. Therefore, two operating ways are optional for the roller sander.

4 Claims, 6 Drawing Sheets

MANUAL CLUTCH DEVICE FOR A ROLLER SANDER FOR CONTROLLING RECIPROCATING MOVEMENT OF A ROLLER

BACKGROUND OF THE INVENTION

1. Field of the Invention

This invention relates to a roller sander, particularly to one having a manual clutch device for controlling a roller in reciprocating movement.

2. Description of the Prior Art

A common conventional roller sander is mainly composed of a base 1 having a conveyer at a preset position above it, a motor set 2 fixed at a preset position at one side of the base 1, a roller set 3 having a sanding cloth wheel able to be driven by the motor set 2, and a linking device 4 mounted by a belt that is mounted around a shaft of the motor set 2 as well, enabling the roller set 3 to reciprocate so that grinding precision may be upgraded thereby. But, if a work of a large thickness is to be ground or if a lower precision for a work is acceptable, the conventional roller sander cannot save time for grinding because it has only one way of grinding with the roller set 3 always reciprocating for high degree of grinding, causing a low efficiency and a high cost for low precision sanding.

SUMMARY OF THE INVENTION

The prime object of this invention is to offer a manual clutch device for a roller sander for controlling reciprocating movement of a roller set.

The main characteristic of the invention is a manual clutch device for a roller sander that includes a base, a motor set, a roller set and a linking device. The clutch device is set at the front end of the linking device, consisting of a belt wheel, a connecting shaft and an adjusting button. The belt wheel is pivotally connected with the connecting shaft, fitted with a bearing in its inner side, able to turn around freely against the connecting shaft. And, the belt wheel is mounted around by a belt that is also mounted around another belt wheel fixed on a shaft of the motor set, so that the belt wheel can be driven by the motor set. Moreover, the belt wheel is provided with a number of fixing grooves spaced apart in a circle at its front end. The connecting shaft is connected with the linking device at its rear end and connected with the adjusting button at the front end. Then the adjusting button can manually be pushed in or pulled out axially, and the connecting shaft fitting through the center of the belt wheel is provided with a slot in its annular outer surface for a fixing bar to fit therein, Then The fixing bar is moved by the adjusting button pushed in or pulled out to enter or retreat from one of the fixing grooves of the belt wheel for controlling the linking device in its work, enabling the reciprocating movement axially of the roller set to be used or not optionally, so as to save time or upgrade grinding precision for various grinding for works.

BRIEF DESCRIPTION OF DRAWINGS

This invention is better understood by referring to the accompanying drawings, wherein.

DETAILED DESCRIPTION OF THE PREFERRED EMBODIMENT

Figure 1:
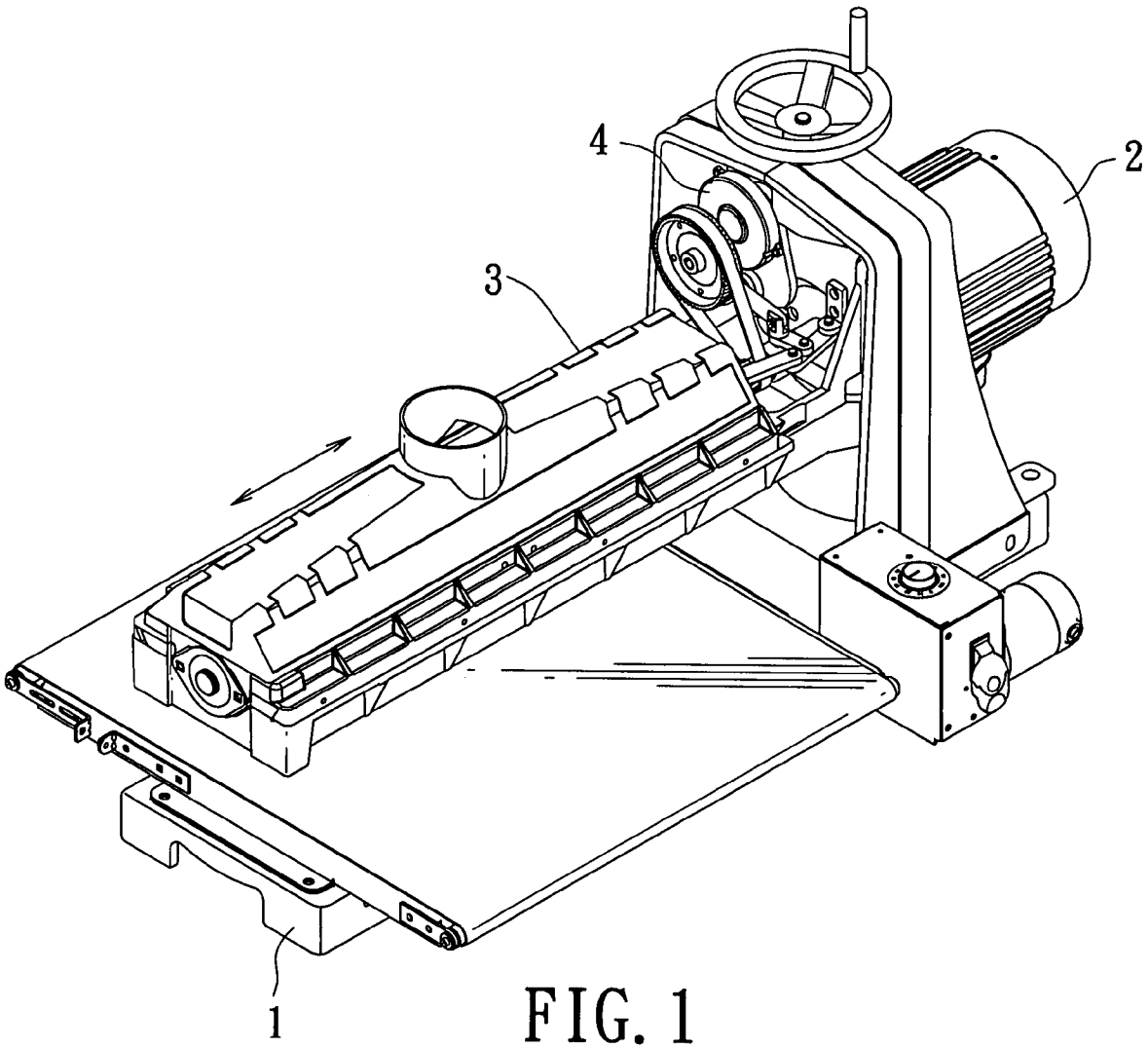
FIG. 1 PRIOR ART
FIG. 1 is a perspective view of a conventional roller sander.
Figure 2:
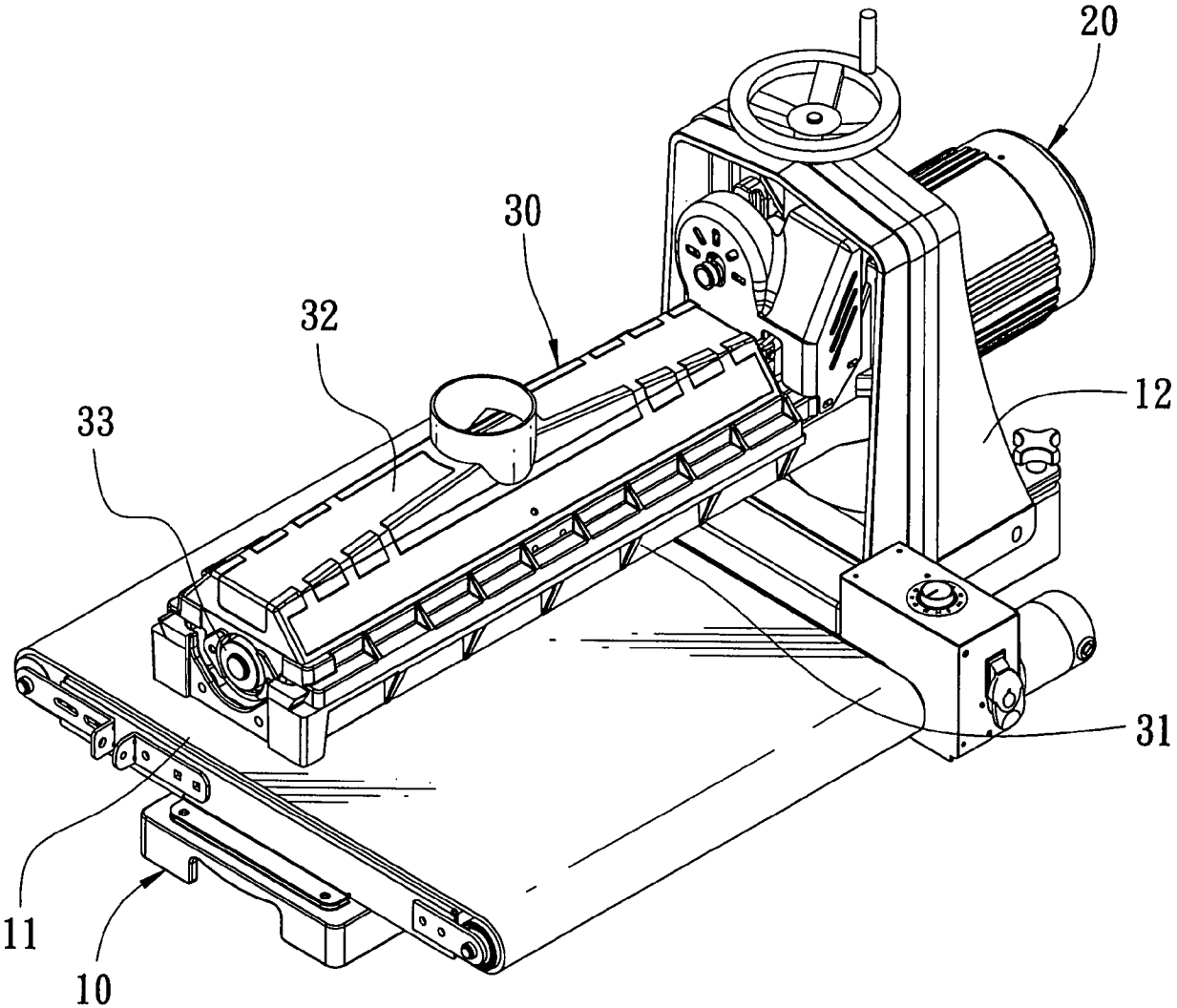
FIG. 2 is a perspective view of the roller sander in the present invention.
Figure 3:
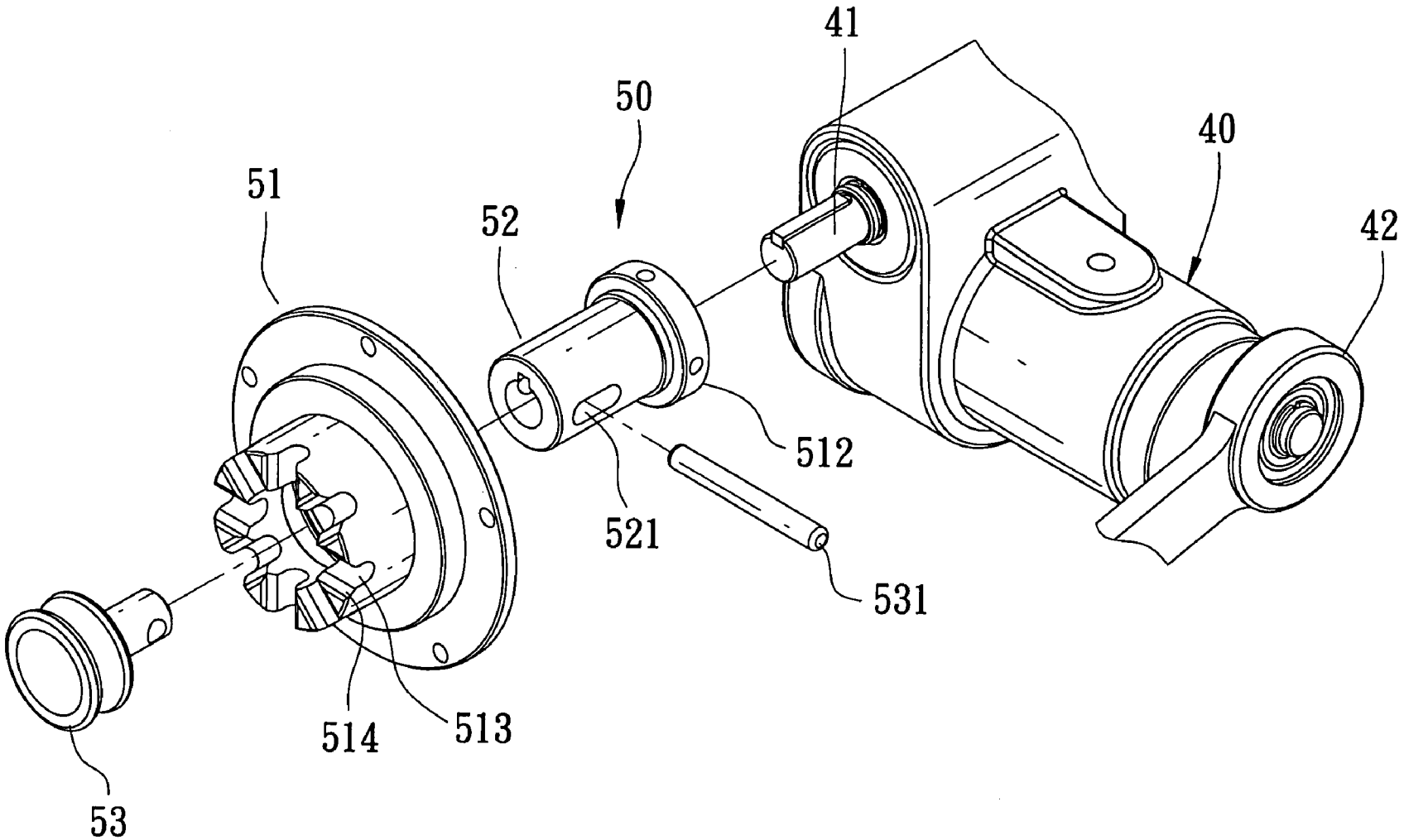
FIG. 3 is a partial exploded perspective view of the roller sander in the present invention.
Figure 4:
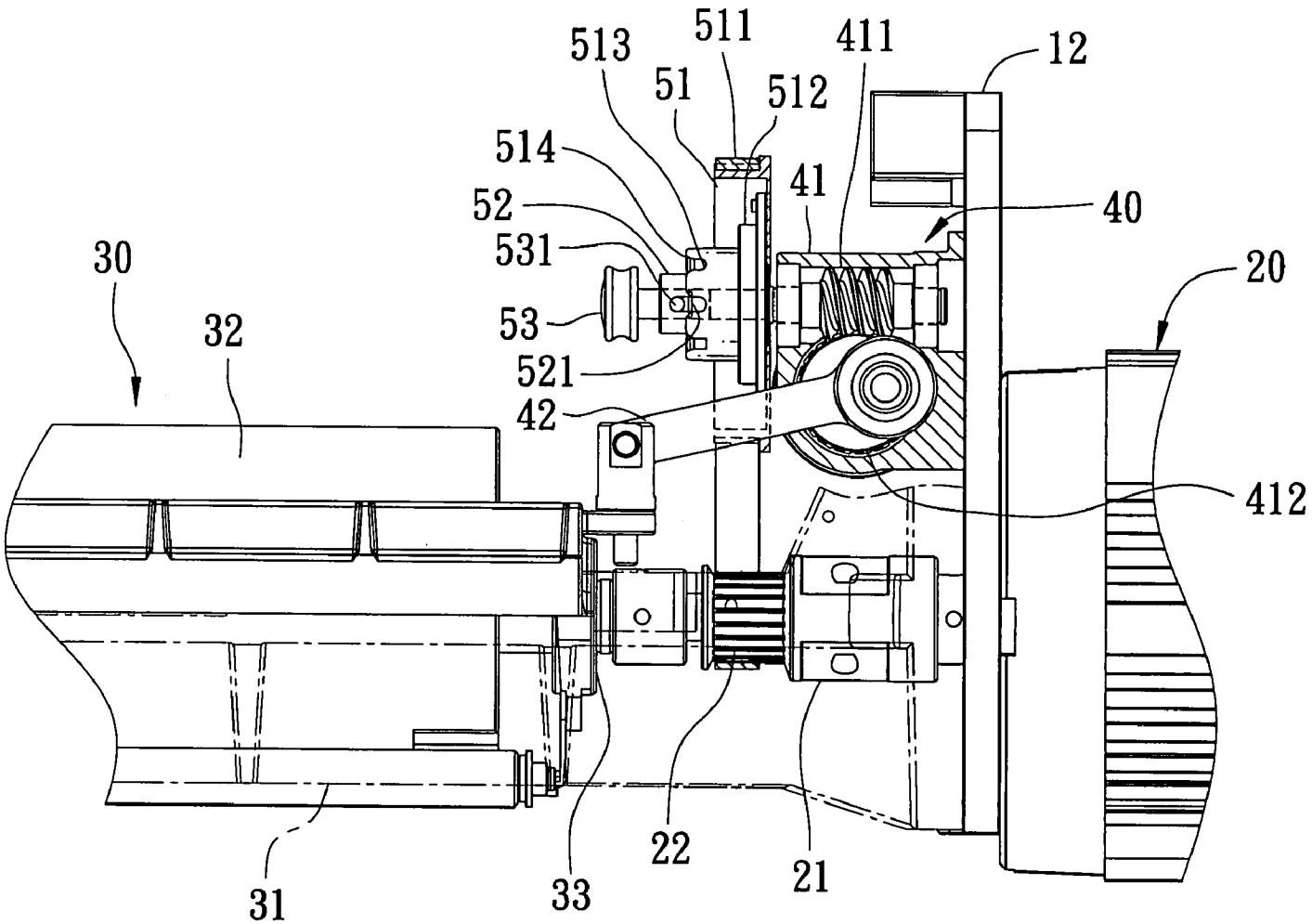
FIG. 4 is a perspective side view of the clutch device in the present invention.

FIGS. 2, 3 and 4, show a preferred embodiment of a manual clutch device 50 for a roller sander for controlling reciprocating movement of a roller in the present invention, and the roller sander includes a base 10, a motor set 20, a roller set 30, a linking device 40 and the clutch device 50.

The base 10 is provided with a conveyer 11 at a preset position on its upper side. Next to one side of the conveyer 11 is provided a motor fixing frame 12 extending vertically from the base 10.

The motor set 20 is fixed at the outer side of the motor fixing frame 12, provided with a shaft 21 extending to the front side and fixed with a belt wheel 22.

The roller set 30 set at the inner side of the motor fixing frame 12 is composed of a lower member 31, an upper member 32 and a sanding cloth wheel 33. The lower member 31 is fixed at one side of the motor fixing frame 12 and the upper side of the conveyer 11. The upper member 32 located above the lower member 31 can slide parallel with the lower member 31, pivotally connected with the sanding cloth wheel 33 at its two sides respectively so as to move together with the sanding cloth wheel 33. And, the sanding cloth wheel 33 is connected with the shaft 21 so that it can be rotated by the motor set 20.

The linking device 40 set at a preset position of the inner side of the motor fixing frame 12 is composed of a reduction gear 41 and a linking shaft 42. The reduction gear 41 is composed of a worm 411 and a worm gear 412. The worm 411 is engaged with the worm gear 412, which is connected eccentrically with the linking shaft 42 at its outer side. The linking shaft 42 is pivotally connected with one side of the upper member 32 of the roller set 30 at its other end. And, the worm 411 is fixed with the clutch device 50 at the front end. So the upper member 32 together with the sanding cloth member 33 can be moved to reciprocate for a certain distance by the linking device 40.

The clutch device 50 is composed of a belt wheel 51, a connecting shaft 52 and an adjusting button 53. A belt 511 is mounted around the belt wheel 51 and also around the belt wheel 221 of the shaft 21 of the motor set 20. The belt wheel 51 is fitted with a bearing 512 in its inner side, able to turn around relatively against the connecting shaft 52. In addition, the belt wheel 51 is provided with a preset number of fixing grooves 513 spaced apart at its front end, and the fixing grooves 513 respectively have an arced corner 514 at their front edge. The connecting shaft 52 is further bored with a slot 521 in an annular outer surface near its front end and fixed with the linking device 40 at its rear end. The adjusting button 53 is connected with the front end of the connecting shaft 52 with a fixing bar 531 inserted transversally and movably in the slot 521 and able to fit in one of fixing grooves 513 of the belt wheel 5 so that the clutch device 50 may operated, if the adjusting button 53 is manually pushed in from a pulled-out position in which the clutch device 50 is not in an operating condition, separated from the linking device 40.

Figure 5:
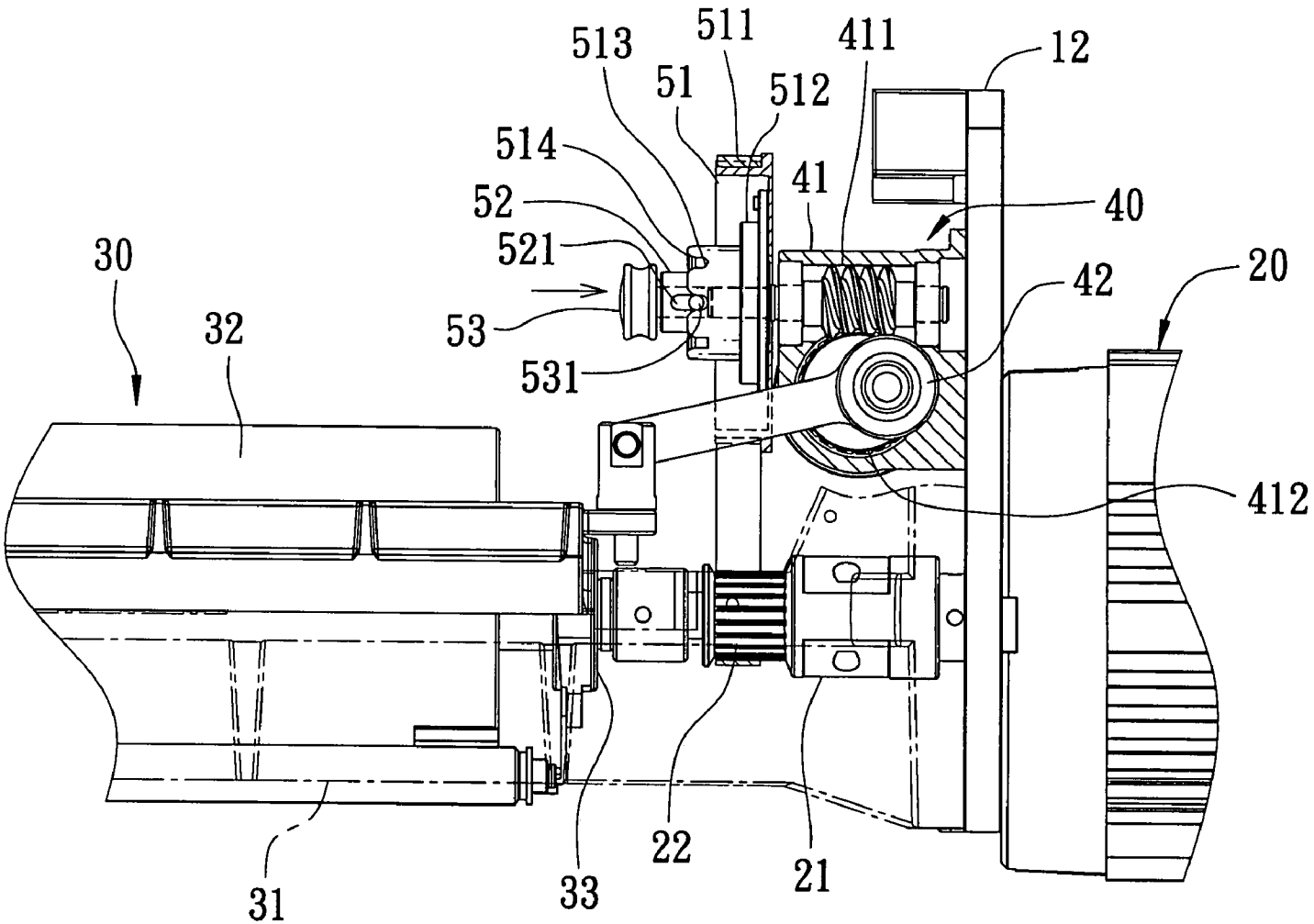
FIG. 5 is a perspective side view of the clutch device in the present invention, showing it being in a working state.
Figure 6:
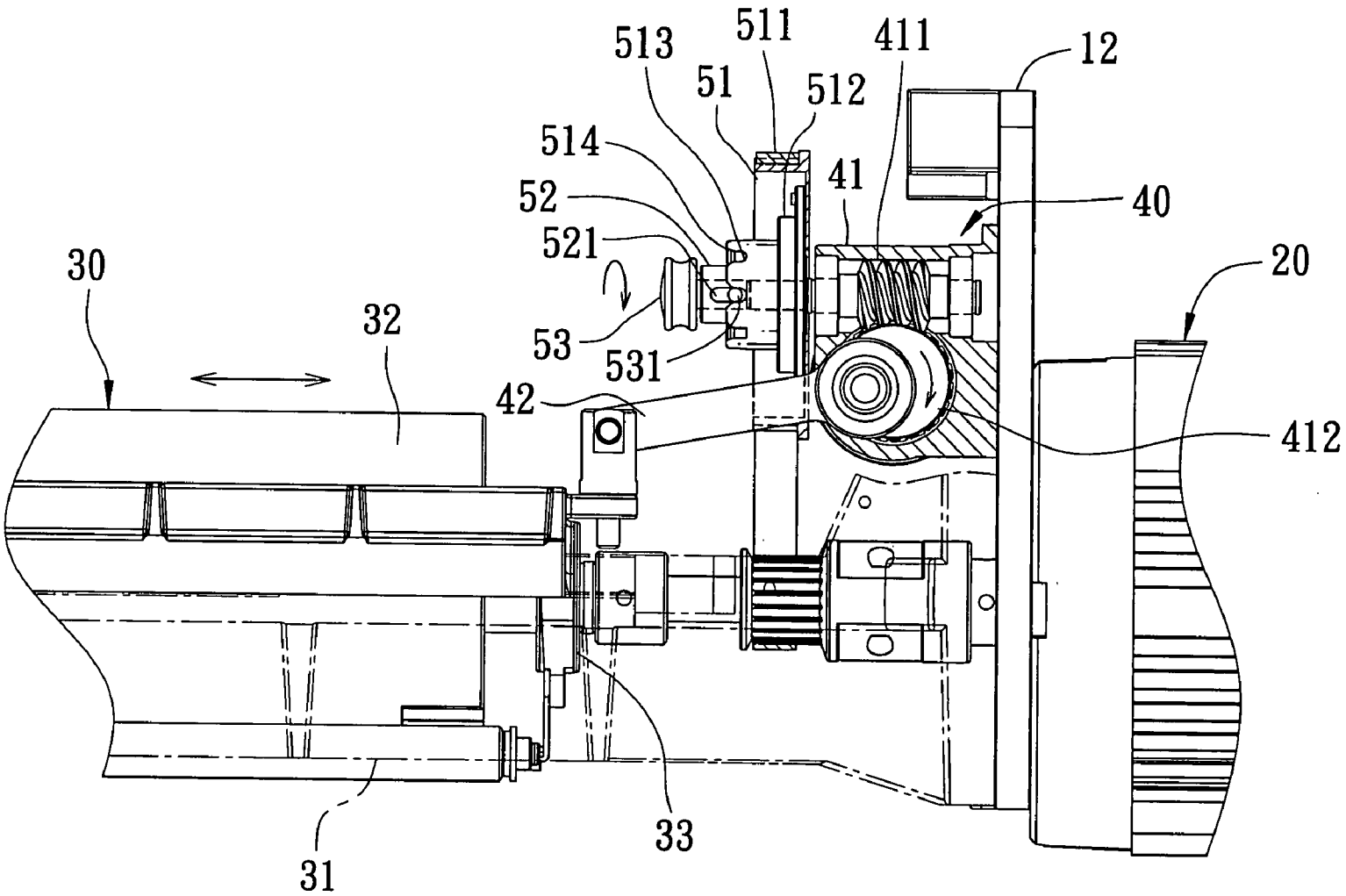
FIG. 6 is a perspective side view of the linking device in the present invention, showing it being in a working state.

In using, as shown in FIG. 4, when the clutch device 50 does not work with the adjusting button manually pulled out, the shaft 21 of the motor set 20 rotates the sanding cloth wheel 33 of the roller set 30 and, simultaneously, the belt 511 mounted around the belt wheel 22 of the shaft 21 drives the belt wheel 51 of the connecting shaft 52 to rotate idle. That means the grinding job is done only by the rotation of the belt wheel 33 of the roller set 30. As shown in FIGS. 5 and 6, when the clutch device 50 is wanted to operate for make the sanding cloth wheel roller 33 rotate plus the reciprocating movement of the sanding cloth wheel together with the upper member 31, the adjusting button 53 is manually pushed in to force the fixing bar 531 also move inward and then the arced corner 514 in front of the fixing bar 513 guides the fixing bar 531 slide and fit in one of the fixing grooves 513 of the belt heel 51. Then the belt 511 moves around the belt wheel 51, which is then rotated, and the connecting shaft 52 enables the worm shaft 411 of the linking device 40 to rotate so that the worm gear 412 is moved to provide an eccentric rotation, enabling the linking shaft 42 of the linking device 40 to drive the upper member 32 of the roller set 30 to make reciprocating movement axially. Of course, at this time, the sanding cloth wheel 33 of the roller set 30 is also rotated by the shaft 21 of the motor set 20. Therefore, a sanding job is done by roller's rotation combined axial movement, making the sanding precision higher.

Finally, the advantages of the roller sander in the present invention are described as below:

The clutch device 50, by adjusting the adjusting button 53, can be controlled to operate or not, providing two options for sanding work so as to save operating time and improve sanding precision according to works needing different degrees of grinding precision.

While the preferred embodiment of the invention has been described above, it will be recognized and understood that various modifications may be made therein and the appended claims are intended to cover all such modifications that may fall within the spirit and scope of the invention.

What is claimed is:

1. A clutch device for a roller sander for controlling reciprocating movement of a roller, said roller sander comprising:

a base set provided with a conveyer at a preset position and a motor fixing frame at its one side;

a motor set fixed at an outer side of said motor fixing frame and having a shaft and a belt wheel fixed on said shaft;

a roller set fixed at an inner side of said motor fixing frame and an upper side of said conveyer and composed of a lower member, an upper member and a sanding cloth wheel, said lower member fixed on said motor fixing frame, said upper member positioned above and in parallel with said lower member and pivotally connected with said sanding cloth wheel at its two sides respectively to be able to move axially together, said sanding cloth wheel driven to rotate by said shaft of said motor set;

a linking device set at the inner side of said motor fixing frame and pivotally connected with said upper member of said roller set and enabling said upper member to reciprocate axially; and said clutch device composed of a belt wheel, a connecting shaft and an adjusting button, said belt wheel pivotally connected with said connecting shaft and mounted around by said belt that mounts around said belt wheel of said motor set as well, and provided with a preset number of fixing grooves spaced apart in a circle at its front end, said connecting shaft bored with a center hole for a rear end of said adjusting button to fit therein and fixed with said linking device at its other end, said adjusting button pivotally connected with a front section of said connecting shaft and provided with a fixing bar fitted transversally and movably in a slot bored in an annular outer surface of said connecting shaft, said fixing bar able to fit in one of said fixing grooves of said belt wheel when said adjusting button is pulled out for a certain distance.

2. The clutch device for a roller sander for controlling reciprocating movement of a roller as claimed in claim 1, wherein said fixing grooves of said belt wheel of said clutch device are respectively provided with an arced corner at its front edge.

3. The clutch device for a roller sander for controlling reciprocating movement of a roller as claimed in claim 1, wherein said linking device is composed of a reduction gear set and a linking shaft; said reduction gear consisting a worm and a worm gear, said worm fixed with one side of a bearing of said clutch device and able to be driven via said bearing to rotate said worm gear; said linking shaft connected eccentrically with said worm gear at its one end and pivotally connected with one side of said upper member of said roller set at its other end, said linking shaft able to be driven by said worm gear to enable said upper member to reciprocate axially for a certain distance.

4. The clutch device for a roller sander for controlling reciprocating movement of a roller as claimed in claim 1, wherein said belt wheel of said shaft of said motor set and that of said clutch device are synchronous belt wheels, and a belt to be mounted around both said belt wheels is a synchronous belt.

* * * * *